United States Patent [19]

Tillié

[11] 3,979,864

[45] Sept. 14, 1976

[54] DEVICE FOR ASSEMBLING AND CONVEYING PREFABRICATED ELEMENTS FOR WALLS AND PARTITIONS OF BUILDINGS

[75] Inventor: Etienne Lucien Tillié, La-Colle-sur-Loud, France

[73] Assignee: Tramex S.A., Luxemburg, Luxemburg

[22] Filed: Dec. 20, 1974

[21] Appl. No.: 534,704

[30] Foreign Application Priority Data

May 17, 1974 France ..... 74.17313

[52] U.S. Cl. ..... 52/122; 52/143;745; 214/1 S

[51] Int. Cl.[2] ..... E04G 21/14

[58] Field of Search ..... 52/122, 143, 745, 747, 52/749, 750, 173; 248/188.1, 357, 188.2; 214/1 S, 1 SW, 1 H; 294/67

[56] References Cited

UNITED STATES PATENTS

| | | | |
|---|---|---|---|
| 1,836,362 | 12/1931 | Crowley | 214/1 S |
| 3,253,852 | 5/1966 | Wheat | 214/1 S |

*Primary Examiner*—J. Karl Bell

[57] ABSTRACT

A method of assembling and conveying pre-fabricated wall elements for buildings having their edges formed with longitudinal assembling grooves with injection of a settable binder therein, consisting in disposing said elements separately on a support with juxtaposition thereof in the proper wall-forming sequence, assembling same through injection of said binder and conveying the assembled elements resting on said support to the building site.

6 Claims, 12 Drawing Figures

DEVICE FOR ASSEMBLING AND CONVEYING PREFABRICATED ELEMENTS FOR WALLS AND PARTITIONS OF BUILDINGS

The invention relates to a method and a device for assembling and conveying pre-fabricated structural elements for the construction of walls and partitions of buildings as well as the prefabricated elements assembled and conveyed according to this method or by means of this device.

Presently, a large number of buildings and edifices are constructed the walls and partitions of which are pre-fabricated by being made from elements individually moulded at the workshop or factory. These elements are conveyed to the building site or workyard for being assembled and used there.

The processes and devices ordinarily used for manufacturing these elements exhibit several significant inconveniences.

The elements are indeed generally moulded in a flat-laid condition on production tracks provided for this purpose. They comprise bricks or polystyrene plates disposed according to a given arrangement onto a first layer of concrete, the joints or gaps between the bricks or polystyrene plates being then filled in with concrete. The handlings of materials take a long time and are more or less difficult in view of the more or less accurate arrangement of the bricks or polystyrene plates and the elements obtained have approximate sizes which vary from one element to the other. Moreover the drying and hardening or setting of the concrete take a very long time of about twenty days so that the works or factories should have available very large storage areas and provide for a manufacture three weeks in advance or supply the builders with at least a three weeks delivery term.

The elements forming composite panels are then lifted by cranes and placed on road transport vehicles or conveyances to be forwarded to the building sites.

In order to overcome the drawbacks of the prior arts and in particular to avoid the requirement of availability of large storage areas and long and delicate handlings of the composite panels the invention provides a method for assembling and conveying prefabricated elements or panels for partitions and walls of buildings, at least some of these elements being formed on their edges with longitudinal grooves and/or cut channels or like nicks enabling to assemble them to each other through juxtaposition and injection or casting of a hardenable or settable binder into the registering or confronting grooves and/or nicks of any two adjacent elements, said method being characterized in that it consists in separately disposing said elements on a support, juxtaposing at least some of these elements in their proper order of succession or sequence corresponding to the formation of a given wall of a building, injecting or casting a settable or hardenable binder into the grooves and/or nicks of the edges of the juxtaposed elements and conveying or carrying these elements kept arranged and/or assembled on said support to the site of utilization.

The method according to the invention therefore enables to avoid the handlings of composite panels constituted by the assembled elements owing to the fact that these elements are directly assembled on the transport support. Moreover the settable or hardenable binder used for assembling the elements consists advantageously of a special concrete including resins the setting time of which is at most of 48 hours thereby significantly reducing the storage requirement of the panels made from the elements.

The invention is also directed to a device for carrying out said method, which is characterized in that it comprises a supporting or carrying frame having at least one face disposed in slightly sloping relation to the vertical direction and on which are arranged the elements, at least one lower bed-plate or pad exhibiting a substantially flat surface extending at right angles to said face of the supporting frame and on which are resting the bottom sides of said elements, and means for retaining and fastening or securing the elements arranged on said supporting frame.

According to another characterizing feature of the invention said supporting frame rests at the site or location for assembling the elements at some distance from the ground with its two longitudinal sides on stationary stringers or like members or beams between which the trailer of a road vehicle may pass.

Thus the loading of the supporting frame onto the platform of the trailer of a road vehicle is carried out very easily as well as the unloading of such a supporting frame.

The operating steps for storing and handling the prefabricated elements intended for the construction of walls and partitions of buildings are therefore greatly reduced by the method and device according to the invention.

The invention will be better understood and further objects, characterizing features, details and advantages thereof will appear more clearly as the following explanatory description proceeds with reference to the accompanying diagrammatic drawings given by way of non-limiting examples only illustrating two presently preferred embodiments of the invention and wherein.

Figure 11:
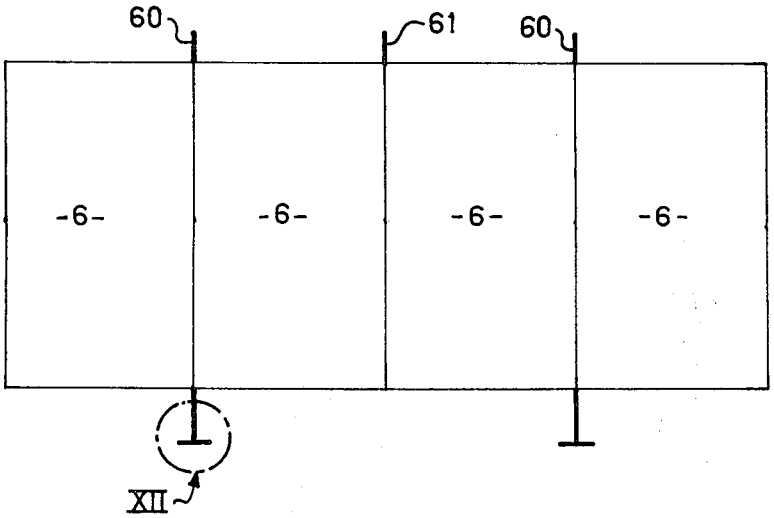
Figure 12:
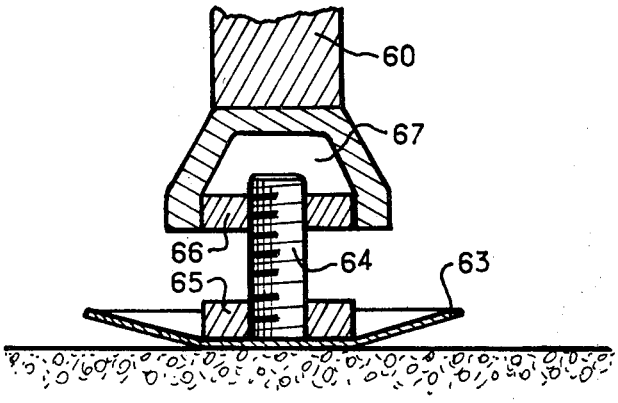

FIG. 11 diagrammatically shows a composite panel consisting of pre-fabricated elements according to the invention; and FIG. 12 is an enlarged sectional view of a detail of FIG. 11.

The device for assembling and conveying or carrying pre-fabricated structural elements, which is shown in the drawings, is adapted to be loaded onto the platform of a trailer of a road vehicle and it rests normally on horizontal parallel stringers or like longitudinal members 1 provided for this purpose on a storage area of manufacturing works.

Figure 1:
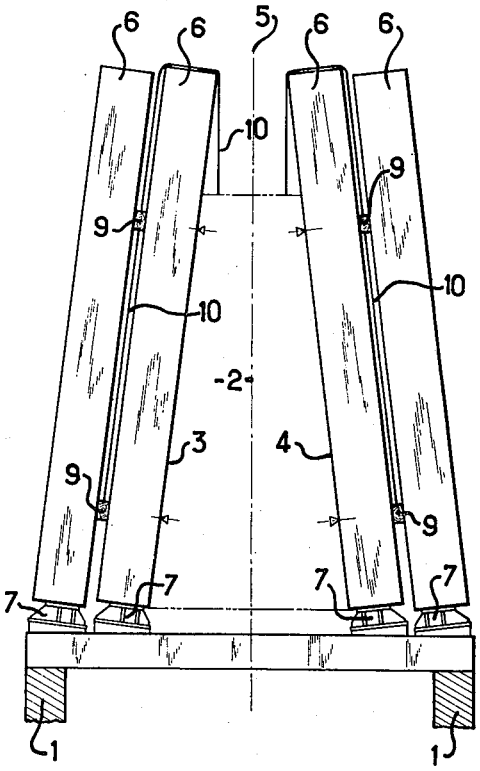
FIG. 1 is a plan view of a device for assembling prefabricated elements according to the invention.

This device comprises a trestle, rack or like stand consisting of a supporting frame 2 diagrammatically shown in FIG. 1, which is formed with two sloping flat faces 3 and 4 which are symmetrical with respect to the vertical longitudinal center plane 5 of the stand. The pre-fabricated elements 6 the edge of which is seen in FIG. 1 are bearing against the flat faces 3 and 4 of the stand and rest with their bottom edges on horizontal pedestals, bed-plates or like pads 7 the top face of which is slightly inclined so as to extend at right angles to the corresponding flat face 3, 4 of the stand to bear the horizontal bottom edges of the elements or panels. The light-weight of the elements according to the invention which are advantageously made from a plaster based material enables to load them on a trailer of a road vehicle in an amount twice as large, thereby correspondingly reducing the carriage or transport charges per element. For this ground, two bed-plates 7 are provided in this embodiment on either longitudinal side of the stand which may thus carry four series of pre-fabricated elements whether assembled or not into composite panels.

Wooden shims or like spacer blocks 9 of suitable thickness are suspended from wire ropes 10 fastened to the frame of the stand and are adapted to be positioned between the elements of the composite panels as shown in FIG. 1.

The stand or rack further comprises means for bearing the major faces of the elements, comprising two longitudinal upper rails 11 and two longitudinal lower rails 12, respectively, disposed in symmetrical relation to the center plane 5. The rails 11 and 12 are symbolically shown by bearing triangles in FIG. 1 and their shapes are shown with more detail in FIGS. 2 and 3.

The rails are advantageously secured by any suitable means onto inclined standards or uprights 13 located in a vertical plane and forming the supporting frame of the stand or rack.

Figure 3:
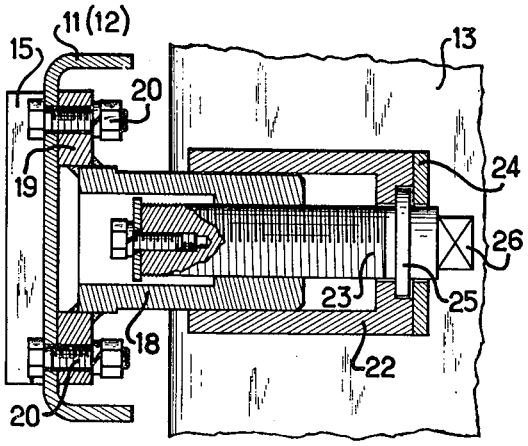
FIG. 3 is a view in vertical cross-section taken upon the line III—III of FIG. 4, showing a bearing means for a pre-fabricated element on the supporting frame of the device according to the invention.
Figure 4:
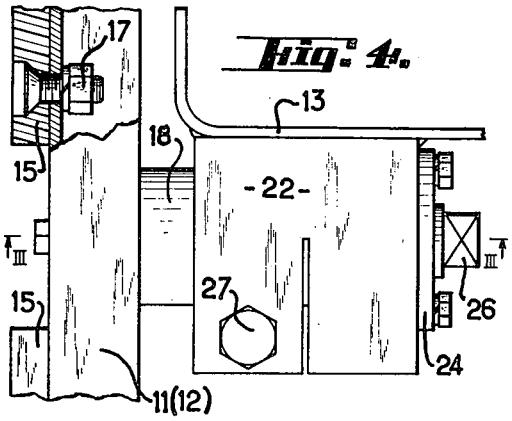
FIG. 4 is a top view, with parts broken away, showing the bearing means illustrated in FIG. 3.
Figure 2:
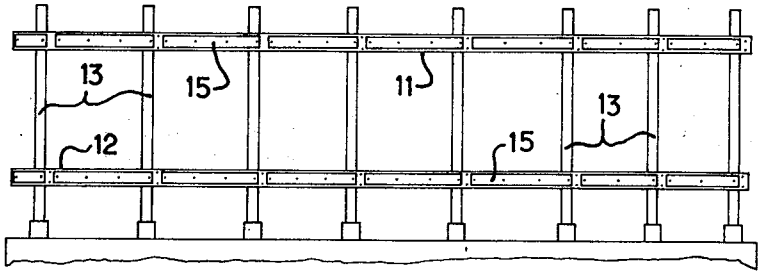
FIG. 2 shows an embodiment of the supporting frame used in the device according to the invention.
Figure 8:
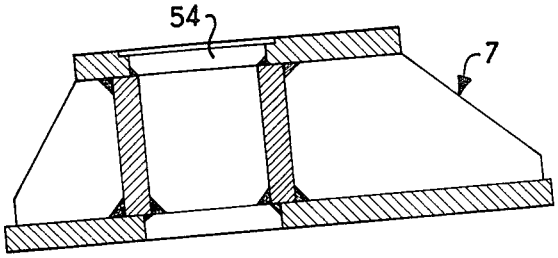
FIGS. 8, 9 and 10 are views in cross-section taken upon the lines VIII—VIII, IX—IX and X—X, respectively, of FIG. 7.
Figure 9:
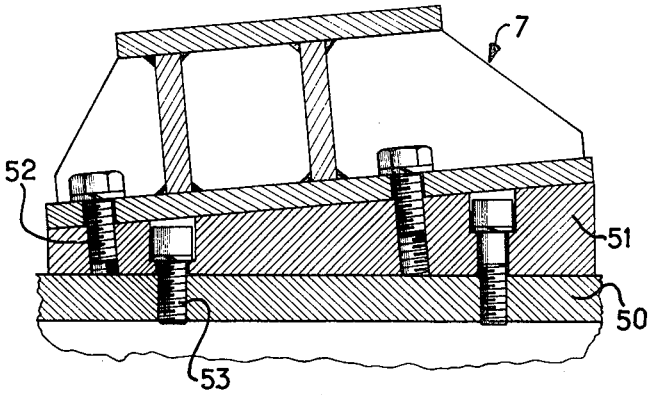
Figure 10:
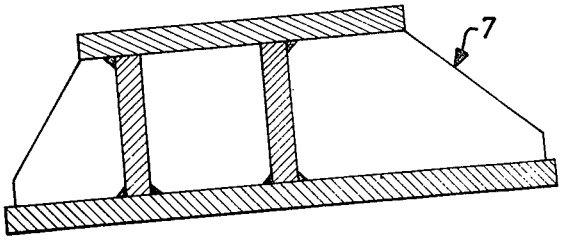
Figure 7:
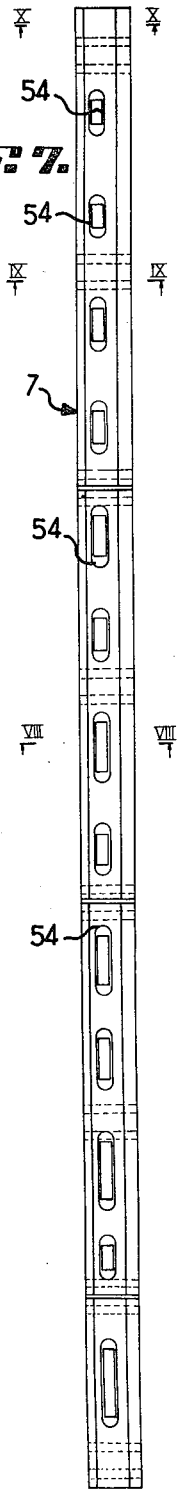
FIG. 7 is a top view of a lower bed-plate or pad of the device shown in FIG. 1.

In a first embodiment illustrated in FIGS. 2 to 4 bearing or backing pads 15 are fastened by means of bolts 17 on the outer faces of the U-shaped sectional bars or channels forming the rails 11 and 12 which are themselves positioned at a variable distance from the standards 13 by means of the device shown in FIGS. 3 and 4.

This adjusting device comprises a cylindrical sleeve 18 one end of which carries a flange 19 secured to the rail 11, 12 by bolts 20. The opposite end of the sleeve 18 is slidably received in a U-shaped holder or like supporting member 22 and is formed with an inner screw thread. A screw threaded spindle or rod 23 is threaded in this end of the sleeve 18 and extends through a plate 24 closing the corresponding side of the holder 22 while being locked therein against translatory motion by a cylindrical collar 25. A polygonal head 26 of the screw-threaded spindle 23 enables to screw more or less said spindle through rotation thereof into the sleeve 18 and therefore to adjust the spacing between one rail 11, 12 and the corresponding sloping standard 13. A bolt 27 connects both flanges or legs of the holder 22 and enables to lock the sleeve 18 in the desired position.

Figure 5:
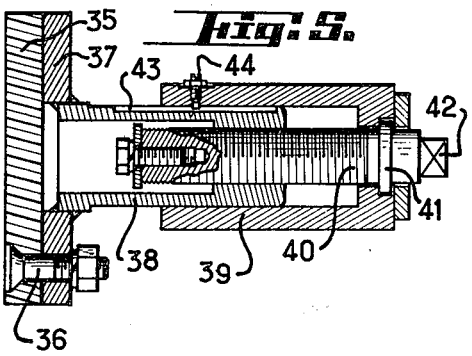
FIG. 5 is a sectional view showing an alternative embodiment of the bearing means for pre-fabricated elements onto the supporting frame.

In a second form of embodiment shown in FIG. 5, the bearing or backing pads 35 are mounted by means of bolts 36 on a flange 37 of one end of a sleeve or socket 38 which is slidably received within a holder 39 rigidly connected to the corresponding rail 11, 12 which is then mounted in stationary relationship onto the sloping standards 13. It should be noted that the holder 39 may also be mounted in rigidly connected relationship on the corresponding sloping standard 13 by any suitable means.

A screw-threaded spindle or rod 40 is as in the first embodiment threaded into the other end of the sleeve or socket 38 and locked against translatory motion within the holder 39 by a cylindrical collar 41. A polygonal head 42 of the screw-threaded spindle projects outwards from the holder 39 and enables by screwing the rod 40 into the sleeve 38 to adjust the position of the pad 35 with respect to the stationary holder 39. A groove 43 closed at both of its ends is provided in the outer surface of the sleeve 38 and a screw 44 threaded into a corresponding hole of the holder 39 extends into the groove 43 to thereby lock the pad 35 against rotation with respect to the holder 39.

Figure 6:
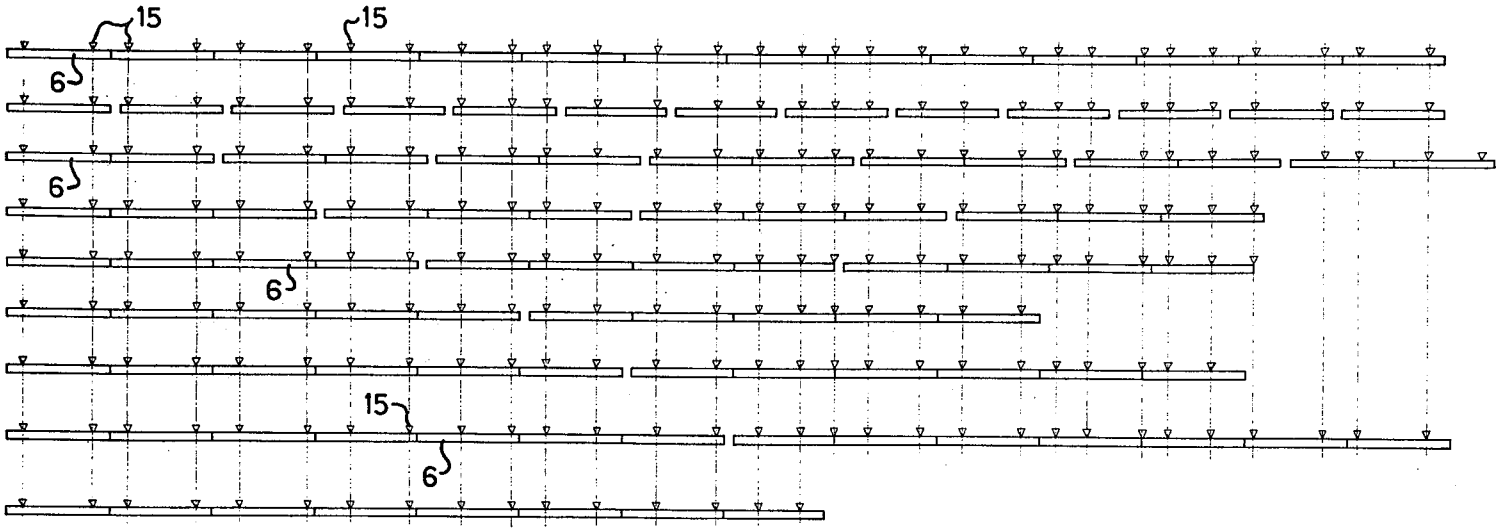
FIG. 6 shows the various possible arrangements of pre-fabricated elements on the supporting frame according to the invention.

The pads 15 and 35 accordingly comprise an outside face onto which are bearing the pre-fabricated elements, this outside face being formed with a suitable smooth or even lining which is not likely to damage or spoil the appearance linings of the pre-fabricated elements according to the invention. Moreover the pads 15, 35 are advantageously distributed as shown in FIG. 6 along the upper and lower rails so that irrespective of the distribution of the pre-fabricated elements on the stand or rack, each element is bearing against at least two pads of each upper and lower rail. Nine examples of arrangements of the elements whether assembled or not into composite panels of various sizes have been shown in FIG. 6, each pre-fabricated element being supported as the case may be by two or three backing pads on each rail. When the rack or stand is empty the positions of the rails carrying the pads 15 or the positions of the pads 35 are adjusted by means of a surface-plate mounted on the stand. Once the adjustment is effected the pads or rails are locked in position and the stand or rack may then be loaded.

In FIGS. 7 to 10 there is shown with more detail an embodiment of a longitudinal bed-plate or like base member 7 which is adapted to support the pre-fabricated elements through their horizontal lower edges. The longitudinal bed-plates 7 are connected to each other and carried by cross-members with wedges 51 being interposed at intervals and having their top faces inclined so that the top face of a bed-plate be perpendicular to the corresponding flat face 3, 4 of the stand. The bed-plate 7 is for instance fastened by bolts 52 onto the plate or wedge 51 which is in turn secured by bolts 53 to the cross-members 50.

Each bed-plate or base member 7 advantageously comprises elongated apertures 54 extending therethrough throughout its thickness and which are distributed in a predetermined fashion over the whole length of the bed-plate for receiving the feet or bases of metal members which are positioned within the interface planes of the joints between any two juxtaposed pre-fabricated elements to form a composite panel for instance of the kind illustrated in FIG. 11.

In such a case, four pre-fabricated elements 6 have been juxtaposed to form a composite panel and metal members 60 and 61 have been positioned within the interface planes of the joints between any two adjacent elements before injection or casting of a settable binder from above. All the metal members project from the horizontal upper edge of the panel whereas the end metal members 60 alone project from the horizontal lower edge and are provided with the device shown in FIG. 12.

This device enables to adjust the horizontal position of the top side of the composite panel mounted in the structure and for this purpose includes a bottom cup 63 adapted to rest on a floor or like element, a screw-threaded rod 64 provided with a head 65 welded to the cup 63 and a nut 66 integral with the lower portion of the member 60 and closing a cavity or recess 67 of the latter.

By screwing or unscrewing the rod 64 within the nut 66, the height or level of the cup 63 with respect to the horizontal bottom edge of the composite panel may be adjusted thereby enabling to adjust the horizontal relationship of the horizontal upper edge of this panel in a simple and effective manner.

Said elongated apertures 54 formed within the bedplates 7 are therefore dimensioned and distributed so as to enable the adjusting devices which have just been described to extend or pass therethrough irrespective of the distribution of the pre-fabricated elements on the stand.

The top ends of the members 60 and 61 may also comprise a flat iron arranged horizontally or at right angles to the longitudinal directions of the members and which may according to circumstances:

serve as an adjusted reference surface, i.e. enable the adjustment of the concrete slab which will be cast in the field onto the top parts of the pre-fabricated elements;

form a flat bearing for the bottom cup 63 of the member 60 of the pre-fabricated element which will be fitted and mounted at the upper level;

enable to provide a continuity through welding between the members of the pre-fabricated element of two adjacent levels (which is often prescribed in those countries or areas which are exposed to a strong seismic activity).

The device for assembling and conveying pre-fabricated elements is therefore used in the following manner: when empty or without any load the stand rests upon the stringers 1 as shown in FIG. 1. The pre-fabricated elements are loaded on the stand and suitably distributed to form or not composite panels depending upon the part of the building to which they are assigned. Metal members 60 and 61 are positioned within the interface planes of the joints between the elements to be assembled and a quickly settable binder such as a concrete including synthetic resins is injected under pressure or cast into the interface planes of joints of the elements to be assembled. After setting of the joint the stand may be loaded directly onto the platform of a road vehicle. For this purpose, the driver adjusts his trailer in a low position and then inserts same between the stringers 1 while properly positioning it below the stand loaded with the pre-fabricated elements. By causing the trailer to rise to a high position the driver lifts off the stand and disengages same from the stringers 1. The stand is thus carried by the platform of the trailer of the vehicle and may be conveyed to the site of use of the pre-fabricated elements. At that time the unloading of an empty or loaded stand is effected in a similar manner the order of succession of the operating steps being reversed, the driver causing his trailer to move between the horizontal stringers and then lowering it for causing the empty or loaded stand to rest upon the stringers.

It should be noted that the invention may also be used with semi-trailers which are provided with a system for loading and unloading a load from the side, i.e. through sidewise translatory motion transversely of the longitudinal direction of the semi-trailer. In such a case the stand to be loaded will merely rest on dies or pedestals and the driver or operator will bring his semi-trailer alongside of the stand in parallel relation to the latter which will then be loaded on the semi-trailer sidewise by means of the loading system thereof. The unloading of a semi-trailer is carried out according to the same principle.

It is thus seen that the invention greatly facilitates the manufacture of composite panels from pre-fabricated elements, their loading, their transport and their unloading as well as the turn round of the road tractors and trailers.

It should be understood that the invention is not at all limited to the forms of embodiment described and shown which have been given by way of example only. In particular it comprises all the means constituting technical equivalents of the means described as well as their combinations if same are carried out according to the gist and used within the scope of the appended claims.

What is claimed is:

1. A device for assembling and conveying in endwise juxtaposed and interconnected relation a plurality of prefabricated panel elements adapted for use as partitions and walls of buildings comprising: a frame having at least one longitudinally extending bed plate in the lower portion of said frame, each said bed plate having a substantially flat upper surface projecting at right angle to said inclined face of the frame and located so as to support the bottom ends of said panel elements thereon, a plurality of longitudinally spaced apertures formed in said bed plates extending through the upper surfaces thereof dimensioned to receive the lower ends of reinforcing members positioned between the adjacently juxtaposed panel elements; and means positionable in said apertures for selectively adjusting the horizontal disposition of the panel elements.

2. A device according to claim 1, wherein said means for selectively adjusting the horizontal disposition of the panel elements includes a plurality of bearing elements each positioned within one of said apertures in said bed plates and adjustable in height.

3. A device according to claim 1, wherein said frame comprises a rack-bike stand which includes a plurality of inclined upright elements and upper and lower longitudinally extending rails secured to said upright elements.

4. A device according to claim 1, including a plurality of adjustable panel bearing members mounted at longitudinally spaced locations along at least one of the faces of said frame and adapted to support said panel elements at selected distances from said at least one face.

5. A device according to claim 4, wherein said adjustable panel element bearing elements are provided with longitudinally extending backing pads.

6. A device according to claim 5, wherein four of said bed plates are arranged longitudinally in pairs positioned in symmetrical relation on opposed sides of the vertical longitudinal plane of the device, the bed plates of each of said pairs of bed plates being parallel and spaced by spacer shims interposed therebetween, the innermost of the panel elements of each said pair being supported against said backing pads and the outer panel elements of each said pair bearing on the inwardly spaced panel element through the medium of the spacer shims.

* * * * *